US006041552A

United States Patent [19]

Lindahl

[11] Patent Number: 6,041,552

[45] Date of Patent: Mar. 28, 2000

[54] INTERLOCK FOR SLIDING WINDOW OR DOOR FRAME ASSEMBLIES

[75] Inventor: Edmond Carl Lindahl, West Vancouver, Canada

[73] Assignee: Marzen Artistic Aluminum Ltd., Langley, Canada

[21] Appl. No.: 08/802,209

[22] Filed: Feb. 18, 1997

[51] Int. Cl.[7] ..... E05D 15/06

[52] U.S. Cl. ..... 49/458

[58] Field of Search ..... 49/409, 458, 501, 49/449

[56] References Cited

U.S. PATENT DOCUMENTS

| | | | |
|---|---|---|---|
| 3,566,950 | 3/1971 | Collins | 160/101 |
| 4,064,653 | 12/1977 | Randall et al. | 49/458 |
| 4,151,682 | 5/1979 | Schmidt | 49/458 X |
| 4,202,137 | 5/1980 | Randall | 49/458 |
| 4,580,366 | 4/1986 | Hardy | 49/406 |
| 4,831,781 | 5/1989 | Morton | 49/458 X |

FOREIGN PATENT DOCUMENTS

| | | | |
|---|---|---|---|
| 2628054 | 1/1978 | Germany | 49/458 |
| 420568 | 3/1967 | Switzerland | 49/458 |
| 481457 | 3/1938 | United Kingdom | 49/458 |

*Primary Examiner*—Jerry Redman
*Attorney, Agent, or Firm*—Oyen Wiggs Green & Mutala

[57] ABSTRACT

An two-piece interlock for sliding window or door frame assemblies comprises a glazing bead secured to a sash frame for engaging a sealed glass unit; and an elongated seal having a T-shaped rail slidable to a limited extent within a longitudinal slot formed in the glazing bead. The seal extends between the sash frames when they are moved to closed positions. The glazing bead and seal on one of the sash frames together define an elongated slot for receiving a tongue formed on the other sash frame in the closed position. The sash frame carrying the glazing bead and seal is slidable to a limited extent relative to the seal to facilitate installation or removal of the sash frame from the outer window or door frame.

14 Claims, 4 Drawing Sheets

INTERLOCK FOR SLIDING WINDOW OR DOOR FRAME ASSEMBLIES

FIELD OF THE INVENTION

This application relates to a two-piece interlock for sliding window or door frame assemblies. The interlock consists of a first piece consisting of a glazing bead which is secured to a sash frame for engaging a sealed unit; and a second piece having an elongated rail which is slidable to a limited extent within a longitudinal slot formed in the glazing bead.

BACKGROUND OF THE INVENTION

Sliding window and door frame assemblies are well known. Such assemblies typically consist of an outer frame and a pair of inner or sash frames mounted within the outer frame, each holding a sealed glass unit. One or both of the sash frames are slidable relative to the outer frame to open or close the window or door.

Interlocks are known in the prior art for releasably securing two sash frames together when they are in a fully closed position. For example, U.S. Pat. No. 4,064,653, which issued to Randall et al on Dec. 27, 1977, relates to a sliding window having sash frames with mating tongues. The tongues engage each other and interlock when the window is closed so that the sashes will not be able to move transversely away from one another. Each tongue is formed on a vertical metal bar secured to an end rail of a sash frame. Randall et al also teaches weather sealing strips slidably mounted on each vertical bar which are received in a slot formed in a bar of the other sash frame when the window is closed. The sealing strips are connected to the sash rails that support them so that the adjoining rails and bars can slide vertically along the sealing strips when the windows are being installed or removed from the outer window frame.

One shortcoming of the Randall et al arrangement is that both sash frames require symmetrical, interengaging bars and sealing strips in order to achieve an effective interlock. Moreover, additional sealing strips or beads are required for engaging the window panes themselves, further increasing costs and complicating window frame assembly.

The need has arisen for a simplified, two piece interlock for a sliding window or door frame assembly comprising a glazing bead secured to one of the sash frames and a slidable seal secured to the glazing bead and extending vertically between the sash frames when the window or door is closed.

SUMMARY OF THE INVENTION

In accordance with the invention an interlock for use in a sliding window or door assembly frame is provided.

Conventional window or door frame assemblies comprise an outer frame having first and second guide channels separated by an inwardly extending central flange. First and second inner sash frames are positionable within the outer frame in corresponding guide channels, at least the first inner sash frame holding a sealed unit. At least one (and preferably both) of the sash frames is slidable relative to the outer frame within a guide channel between an open and a closed position.

The applicant's interlock includes a glazing bead securely connectable to the first inner sash frame for engaging the sealed unit, the glazing bead having a longi-tudinal first slot formed therein; and an elongated seal for substantially extending between the central flange on opposite sections of the outer frame, the seal having a rail which is slidably insertable into the first slot. The glazing bead and the seal define an elongated second slot therebetween for receiving a tongue portion of the second inner sash frame to couple the first and second inner sash frames together in the closed position.

Preferably the seal comprises a flange portion extending between the inner sash frames in a plane generally parallel thereto, and a rail extending perpendicular to the flange portion for engaging the glazing bead. End portions of the rail are truncated such that the length of the rail is less than the length of the flange portion. The length of the first slot also preferably exceeds the length of the rail to permit a limited degree of sliding movement of the first inner frame relative to the seal.

Preferably the rail is generally T-shaped in cross-section and extends from a central region of the flange portion.

The glazing bead may include a leg securely insertable into a slot formed in the first inner sash frame.

BRIEF DESCRIPTION OF THE DRAWINGS

In drawings which illustrate a preferred embodiment of the invention, but which should not be construed as limiting the spirit or scope thereof.

DETAILED DESCRIPTION OF THE PREFERRED EMBODIMENT

Figure 1:
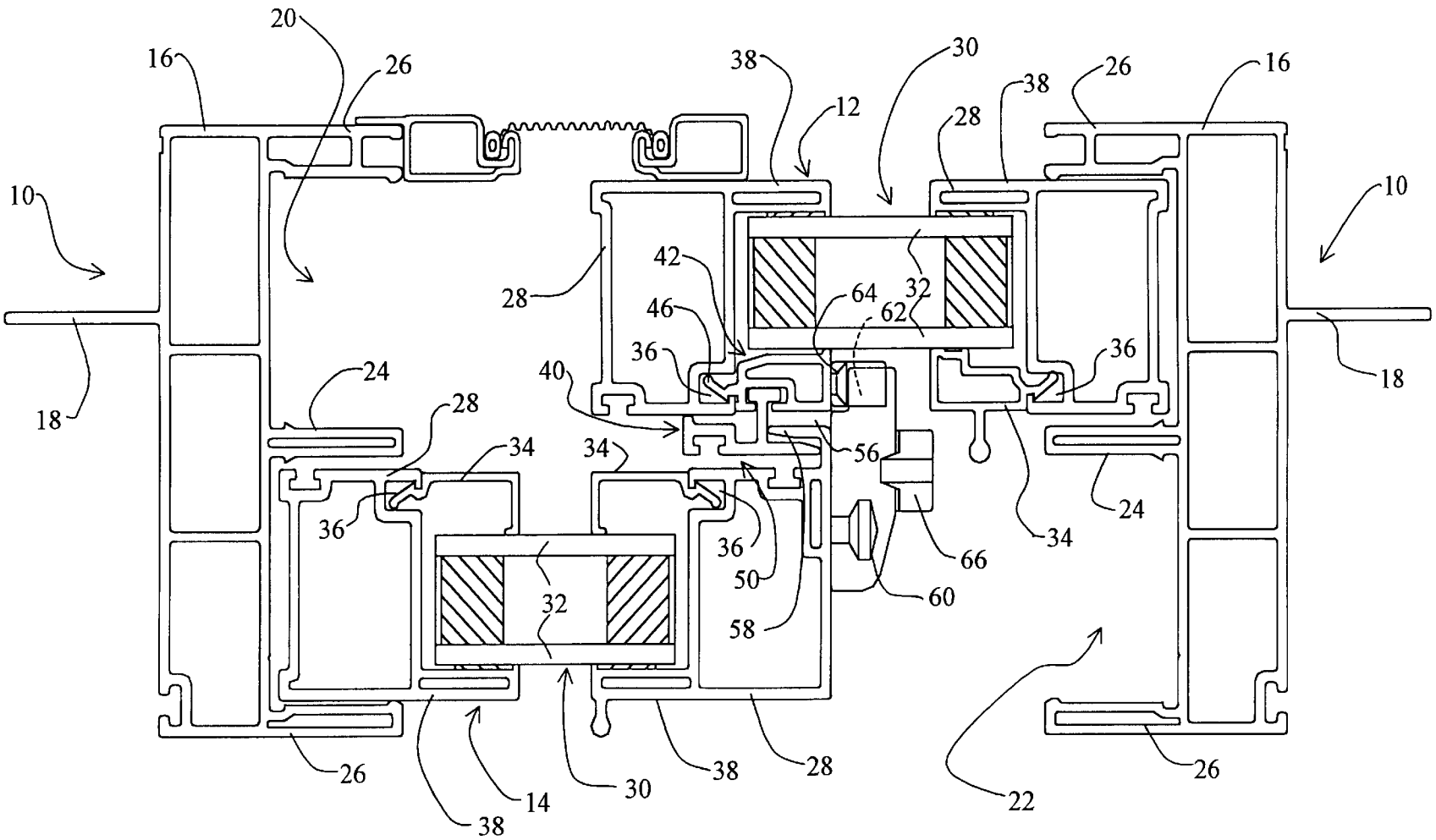
FIG. 1 is a longitudinal cross-sectional view of a window frame assembly illustrating the applicant's interlock for coupling a pair of slidable sash frames together.

With reference to FIG. 1, sliding window or door frame assemblies typically comprise an outer frame 10 for holding two inner or sash frames 12 and 14. At least one sash frame 12, 14 is slidable relative to outer frame 10 to open and close the window.

Outer frame 10 comprises four sections 16 formed from extruded vinyl or the like which are joined together in a rectangular shape. Frame sections 16 are typically identical in cross-sectional profile and are fused or welded together at their corners to form frame 10. Each frame section 16 includes a mounting flange 18 for securing the window frame 10 to a support structure, such as the siding of a building.

Each frame section 16 further includes first and second guide channels 20, 22 which are separated by a narrow, inwardly projecting central divider 24 which extends around the interior of frame 10 when sections 16 are secured together. Each channel 20, 22 is defined between central divider 24 and an outer sidewall 26 of frame 10.

Each sash frame 12, 14 is insertable into a respective frame guide channel 20, 22. In the illustrated embodiment, both sash frames 12, 14 are slidable. However, in an alternative embodiment, one of the sash frames 12, 14 could be fixed and the other sash frame 12, 14 could be slidable.

The bottom surface of each sash frame 12, 14 preferably includes rollers which are designed to travel over tracks (not shown) inserted into the bottom of guide channels 20, 22.

Each sash frame 12, 14 includes four extruded frame sections 28 which are fastened together in a rectangular shape for holding a sealed unit 30. As used in this specification, the term "sealed unit" refers to any window or door structure held by a sash frame. Sealed unit 30 typically consists of two or more spaced-apart glass panes 32 which extend in parallel planes and are sealed around the edges with a silicone product to create an airtight space which provides insulating qualities. However, in some applications, sealed unit 30 could consist of a single glass pane 32 (i.e. single glazing).

Glazing beads 34, which are insertable into channels 36 formed in frame sections 28, are provided to hold each sealed unit 30 securely in place. More particularly, each end of sealed unit 30 is rigidly held in place between an abutment 38 of sash frame section 28 and an opposed glazing bead 34 (FIG. 1).

Sash frames 12, 14 partially overlap when they are slid to fully closed positions as shown in FIG. 1. The applicant has developed a two-piece interlock 40 for releasably securing sash frames 12, 14 together in the fully closed position. Interlock 40 is secured to one of the sash frames (frame 12 in the illustrated embodiment).

Figure 2:
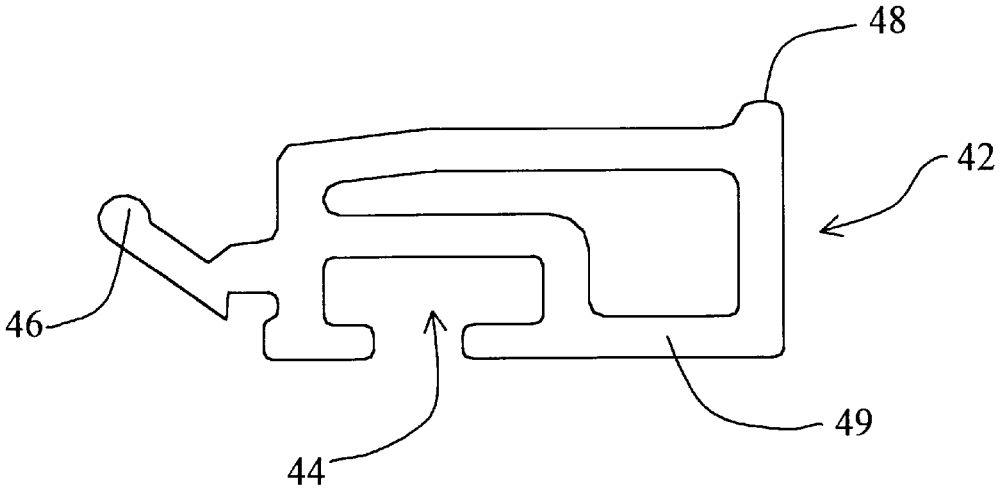
FIG. 2 is a plan view of the glazing bead component of the interlock of FIG. 1.
Figure 3:
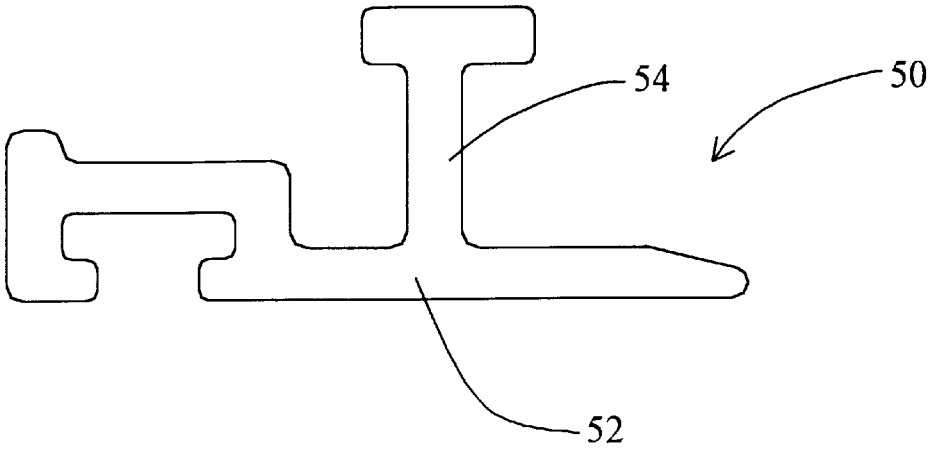
FIG. 3 is a plan view of the seal component of the interlock of FIG. 1.

With reference to FIG. 2, the first piece of interlock 40 consists of a glazing bead 42 which functions in a manner similar to glazing beads 34 but includes an elongated longitudinal slot 44. Glazing bead 42 also includes a leg 46 which fits securely into channel 36 of sash frame 12; an outer surface 48 for engaging sealed unit 30; and an inner surface 49 adjacent slot 44 which faces the other sash frame 14.

Figure 4:
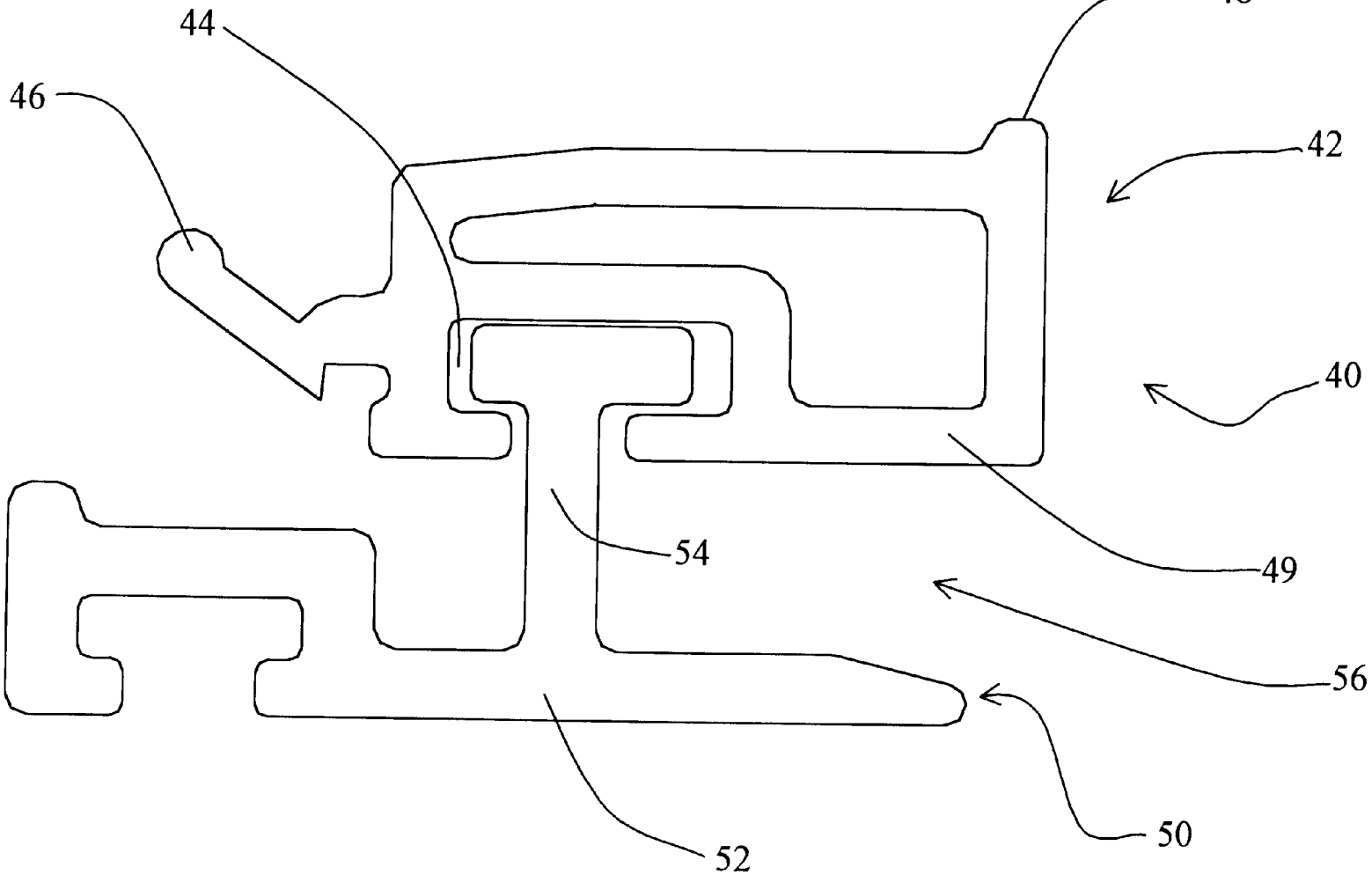
FIG. 4 is a plan view of the assembled inter-lock of FIG. 1.
Figure 5:
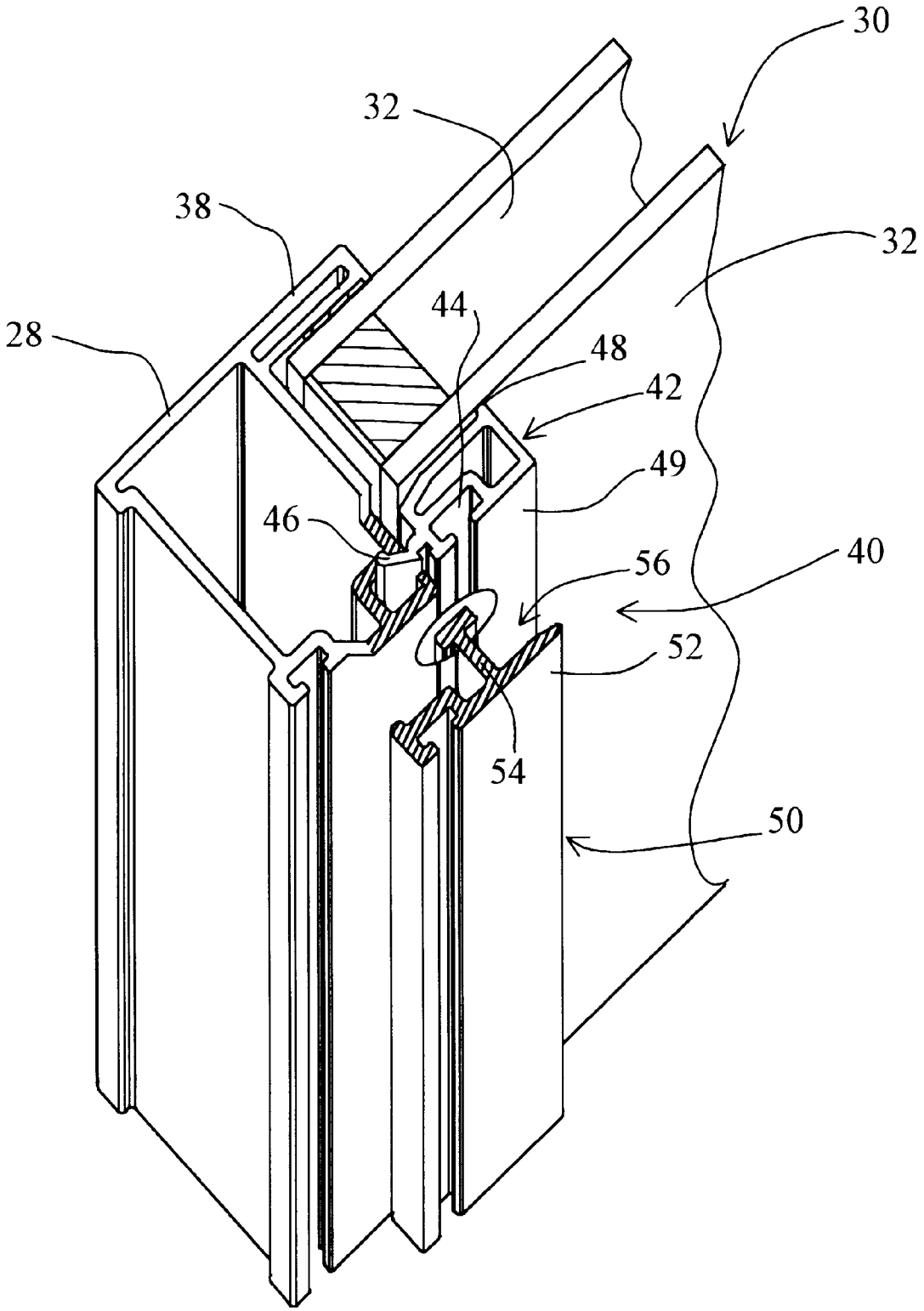
FIG. 5 is a fragmentary isometric view, partially in cross-section, of a sliding sash frame showing the applicant's interlock in its installed configuration.

The second piece of interlock 40 consists of an elongated seal 50 having a flange 52 and a T-shaped rail 54 extending therefrom. As shown in FIGS. 1, 4 and 5, rail 54 is slidably received in slot 44 of glazing bead 42 to couple members 42 and 50 together. The end portions of rail 54 are truncated so that the overall length of the rail 54 is less than the remainder of seal 50 (including flange 52) and also less than the length of slot 44. This permits sash frame 12 to slide upwardly and downwardly to a limited extent relative to seal 50 as discussed further below. In one embodiment of the invention seal 50 is approximately 49 cm in overall length; rail 54 is approximately 44 cm in length; and slot 44 is approximately 46 cm in length. Accordingly, in this embodiment glazing bead 42 and seal 50 can slide approximately 2 cm relative to one another.

When glazing bead 42 and seal 50 of interlock 40 are assembled together, a narrow elongated slot 56 is defined between inner surface 49 of glazing bead 42 and flange 52 of seal 50 (FIGS. 4 and 5). As shown best in FIG. 1, a frame section 28 of sash frame 14 includes a tongue portion 58 which is received within slot 56 to couple sash frames 12 and 14 together in the closed position. A latch 60 mounted on sash frame 14 may be provided for positively locking sash frames 12, 14 together in the closed position so that they will not be able to slide transversely away from one another. Latch 60 may include a tongue 62 insertable into a keeper 64 mounted on glazing bead 42 when a latch handle 66 is rotated.

In operation, it is occasionally necessary to remove sash frames 12, 14 from their respective guide channels 20, 22 formed in frame 10 (for example, to service a damaged sealed unit 30). Accordingly, there must be sufficient clearance to raise each sash 12, 14 within its respective guide channel 20, 22 high enough so that the bottom of the sash may be swung out laterally clearing the outer sidewall 26 of frame 10 (typically there is a space of approximately 1–2 cm between the top of sash frames 12, 14 and the overlying frame 10). To insert or reinsert the sash frame 12, 14 into frame 10, this procedure is reversed.

When sash frame 12 is installed within guide channel 20, seal 50 of interlock 40 extends between central divider 24 on opposed sill and header portions of frame 10. Seal 50 helps prevent penetration of moisture between sash frames 12, 14 to provide the sliding window or door frame assembly with improved insulating qualities. Since glazing bead 42, and hence sash frame 12, are slidably coupled to seal 50 as discussed above, it is possible to slide sash frame 12 upwardly relative to stationary seal 50 in order to remove sash frame 12 from outer frame 10 as discussed above. Similarly sash frame 12 can slide downwardly relative to seal 50 when sash frame 12 is re-installed into outer frame 10.

If seal 50 was rigidly connected to sash frame 12, the above-described advantages would not be achievable. It would be necessary to decrease the length of the seal 50 in order to provide sufficient clearances to remove and re-install sash frame 12, which would inevitably reduce the effectiveness of the seal.

As will be apparent to those skilled in the art in the light of the foregoing disclosure, many alterations and modifications are possible in the practice of this invention without departing from the spirit or scope thereof. Accordingly, the scope of the invention is to be construed in accordance with the substance defined by the following claims.

What is claimed is:

1. An interlock for use in a sliding window frame assembly having an outer frame including first and second guide channels separated by an inwardly extending central flange; and first and second inner sash frames positionable within said outer frame in respective first and second guide channels, at least said first inner sash frame holding a sealed unit and at least one of said sash frames being slidable relative to said outer frame between an open and a closed position, said interlock comprising:

(a) a glazing bead securely connectable to said first inner sash frame for engaging said sealed unit, said glazing bead having a longitudinal first slot formed therein; and (b) an elongated seal comprising:

(i) a flange having a length sufficient to substantially extend between said central flange on opposite sections of said outer frame; and (ii) a rail formed on said flange which is insertable into said first slot for coupling said glazing bead and said seal together, wherein end portions of said rail are truncated such that the length of said rail is less than the length of said flange and less than the length of said first slot to permit a limited degree of sliding movement of said glazing bead relative to said seal, wherein said glazing bead and said flange define therebetween an elongated second slot for receiving a tongue portion of said second inner sash frame to couple said first and second inner sash frames together in said closed position.

2. The interlock of claim 1, wherein said rail is generally T-shaped in cross-section.

3. The interlock of claim 2, wherein said rail extends from a central portion of said flange.

4. The interlock of claim 1, wherein said glazing bead further comprises a leg securely insertable into a slot formed in said first inner sash frame.

5. The interlock as defined in claim 1, wherein said flange extends in a plane perpendicular to said rail.

6. A sliding window assembly comprising:

(a) an outer frame defining a window opening, said outer frame having a header, a sill and opposed jamb frame sections each comprising an inwardly extending central flange;

(b) a pair of inner sash frames extending within said outer frame in planes parallel to the plane of said window opening, at least one of said sash frames being slidable relative to said outer frame between open and closed positions;

(c) a glazing bead secured to one of said sash frames for engaging a sealed unit held by said sash frame, said glazing bead having a longitudinal first slot formed therein; and (d) an elongated seal comprising:

(i) a flange positionable between said inner sash frames and having a length sufficient to extend substantially between said central flange on said header and sill frame sections; and (ii) a rail formed on said flange which is inserted into said first slot for coupling said glazing bead and said seal together, wherein end portions of said rail are truncated such that the length of said rail is less than the length of said flange and less than the length of said first slot to permit a limited degree of sliding movement of said glazing bead relative to said seal, wherein said glazing bead and said seal together define an elongated second slot therebetween for receiving a tongue portion of the other of said sash frames to interlock said sash frames in said closed position.

7. The assembly of claim 6, wherein said rail is generally T-shaped in cross-section.

8. The assembly of claim 6, wherein said tongue portion comprising an elongated flange integrally formed on an end of the other of said sash frames.

9. The assembly of claim 6, wherein said glazing bead further comprises a leg securely insertable into a slot formed in said one of said inner sash frames.

10. The assembly of claim 6, wherein both of said inner sash frames are slidable relative to said outer frame.

11. The assembly of claim 6, further comprising releasable locking means comprising a latch mounted on the other of said inner sash frames and a keeper mounted on said glazing bead for releasably receiving said latch in said closed position.

12. The assembly of claim 6, wherein said flange extends in a plane parallel to said inner sash frames.

13. In a sliding window assembly comprising an outer frame having first and second guide channels separated by an inwardly extending central flange; and first and second inner sash frames each slidable within said outer frame in respective first and second guide channels between an open and a closed position, at least said first inner sash frame holding a sealed unit, the improvement comprising:

(a) a glazing bead securely connectable to said first inner sash frame for engaging said sealed unit, said glazing bead having a longitudinal first slot formed therein; and (b) an elongated seal comprising:

(i) a flange having a length sufficient to substantially extend between said central flange on opposite sections of said outer frame; and (ii) a rail formed on said flange which is insertable into said first slot for coupling said glazing bead and said seal together, wherein end portions of said rail are truncated such that the length of said rail is less than the length of said flange and less than the length of said first slot to permit a limited degree of sliding movement of said glazing bead relative to said seal, wherein said glazing bead and said seal define an elongated second slot therebetween for receiving a tongue portion of said second inner sash frame to couple said first and second inner sash frames together in said closed position.

14. A sliding door assembly comprising:

(a) an outer frame defining a door opening, said outer frame having a header, a sill and opposed jamb frame sections each comprising an inwardly extending central flange;

(b) a pair of inner sash frames extending within said outer frame in planes parallel to the plane of said door opening, at least one of said sash frames being slidable relative to said outer frame between open and closed positions;

(c) a glazing bead secured to one of said sash frames for engaging a sealed unit held by said sash frame, said glazing bead having a longitudinal first slot formed therein; and (d) an elongated seal comprising:

(i) a flange positionable between said inner sash frames and having a length sufficient to extend substantially between said central flange on said header and sill frame sections; and (ii) a rail formed on said flange which is inserted into said first slot for coupling said glazing bead and said seal together, wherein end portions of said rail are truncated such that the length of said rail is less than the length of said flange and less than the length of said first slot to permit a limited degree of sliding movement of said glazing bead relative to said seal, wherein said glazing bead and said seal together define an elongated second slot therebetween for receiving a tongue portion of the other of said sash frames to interlock said sash frames in said closed position.

* * * * *